US011773580B2

(12) United States Patent
Schluter

(10) Patent No.: US 11,773,580 B2
(45) Date of Patent: Oct. 3, 2023

(54) FRAME FOR A FLOOR DRAIN

(71) Applicant: Schluter Systems L.P., Plattsburgh, NY (US)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 493 days.

(21) Appl. No.: 17/114,916

(22) Filed: Dec. 8, 2020

(65) Prior Publication Data

US 2021/0189712 A1 Jun. 24, 2021

(51) Int. Cl.
*E03F 5/04* (2006.01)

(52) U.S. Cl.
CPC ..... *E03F 5/04* (2013.01); *E03F 5/0407* (2013.01)

(58) Field of Classification Search
CPC ..... E03C 5/04; E03C 5/0407; E03C 5/0408
USPC ..... 4/292
See application file for complete search history.

(56) References Cited

U.S. PATENT DOCUMENTS

| | | | |
|---|---|---|---|
| 1,406,068 | A | 2/1922 | Padgett |
| 2,419,996 | A | 5/1947 | Honikman |
| 2,436,593 | A | 2/1948 | Moselowitz |
| 2,701,027 | A | 2/1955 | Scoville |
| 2,749,999 | A | 6/1956 | Schmid |
| 3,225,545 | A | 12/1965 | Flegel |
| 3,246,582 | A | 4/1966 | Wade et al. |
| 3,418,669 | A | 12/1968 | Maxwell |
| 3,774,765 | A | 11/1973 | Kane et al. |
| 4,235,008 | A | 11/1980 | Meredith |
| 4,462,123 | A | 7/1984 | Morris et al. |
| 4,490,067 | A | 12/1984 | Dahowski |
| 4,498,807 | A | 2/1985 | Kirkpatrick et al. |
| 4,515,498 | A | 5/1985 | Thomann et al. |
| 4,553,874 | A | 11/1985 | Thomann et al. |
| RE32,248 | E | 9/1986 | Blecher |
| 4,621,939 | A | 11/1986 | Thomann et al. |
| 4,630,962 | A | 12/1986 | Thomann et al. |
| 4,630,966 | A | 12/1986 | Karbstein |
| 4,640,643 | A | 2/1987 | Williams |
| 4,699,544 | A | 10/1987 | Karbstein |
| 4,751,945 | A | 6/1988 | Williams |

(Continued)

FOREIGN PATENT DOCUMENTS

| | | | |
|---|---|---|---|
| DE | 10056130 | A1 | 7/2002 |
| DE | 202006002077 | U1 | 6/2007 |

(Continued)

*Primary Examiner* — Huyen D Le
(74) *Attorney, Agent, or Firm* — Jason Jones

(57) ABSTRACT

A frame (4) is designed to be inserted into a channel body (3) of a floor drain (1), the channel body forming an outflow channel (8) and having an outflow opening (9). The frame includes at least substantially vertically extending side walls (11) arranged in the form of a frame and which together form a receiving opening (12). An at least substantially horizontally extending frame flange (13) adjoins the upper edges of the side walls (11) and surrounds the receiving opening (12) in a frame-like manner. Projections (14) projecting into the receiving opening (12) are provided on opposite side walls (11) and form a receiving framework to receive and support a cover (5) to be inserted into the frame (4) from above, characterized in that the projections (14) are provided in the form of indentations.

8 Claims, 4 Drawing Sheets

(56) References Cited

U.S. PATENT DOCUMENTS

| | | | |
|---|---|---|---|
| 4,815,888 | A | 3/1989 | Stegmeier |
| 4,844,655 | A | 7/1989 | Aleshire |
| 4,883,590 | A | 11/1989 | Papp |
| 4,940,359 | A | 7/1990 | Vanduyn et al. |
| RE33,439 | E | 11/1990 | Thomann et al. |
| 4,993,877 | A | 2/1991 | Beamer |
| 4,993,878 | A | 2/1991 | Beamer |
| 5,000,621 | A | 3/1991 | Beamer |
| 5,022,430 | A | 6/1991 | Degooyer |
| 5,066,165 | A | 11/1991 | Wofford et al. |
| 5,154,024 | A | 10/1992 | Noel |
| 5,181,793 | A | 1/1993 | Dekel |
| 5,213,438 | A | 5/1993 | Baerenwald |
| 5,226,748 | A | 7/1993 | Baerenwald et al. |
| 5,256,000 | A | 10/1993 | Beamer |
| 5,281,051 | A | 1/1994 | Stegall |
| 5,281,052 | A | 1/1994 | Beamer |
| 5,340,234 | A | 8/1994 | Rossi |
| 5,372,457 | A | 12/1994 | Rante |
| 5,372,715 | A | 12/1994 | Maggard et al. |
| 5,399,047 | A | 3/1995 | Stegall |
| 5,443,327 | A | 8/1995 | Akkala et al. |
| 5,458,769 | A | 10/1995 | Johannessen |
| 5,462,383 | A | 10/1995 | Van 'T Veer |
| 5,478,169 | A | 12/1995 | Stegall |
| 5,522,675 | A | 6/1996 | Gunter |
| 5,529,436 | A | 6/1996 | Meyers |
| 5,538,361 | A | 7/1996 | Beamer |
| 5,568,995 | A | 10/1996 | Beamer |
| 5,573,350 | A | 11/1996 | Stegall |
| 5,573,351 | A | 11/1996 | Beamer |
| 5,613,804 | A | 3/1997 | Beamer |
| 5,647,689 | A | 7/1997 | Gunter |
| 5,647,692 | A | 7/1997 | Gunter |
| 5,653,553 | A | 8/1997 | Gunter |
| 5,702,204 | A | 12/1997 | Gunter |
| 5,718,537 | A | 2/1998 | Becker et al. |
| 5,729,937 | A | 3/1998 | Mantelli |
| 5,735,637 | A | 4/1998 | Gunter |
| 5,735,638 | A | 4/1998 | Beamer |
| 5,779,393 | A | 7/1998 | Gunter |
| 5,803,662 | A | 9/1998 | Gunter |
| 5,853,265 | A | 12/1998 | Gunter |
| 5,890,839 | A | 4/1999 | Gunter |
| 5,971,662 | A | 10/1999 | Becker et al. |
| 6,000,881 | A | 12/1999 | Becker et al. |
| 6,004,068 | A | 12/1999 | Hosley |
| 6,027,283 | A | 2/2000 | Schweinberg et al. |
| 6,113,311 | A | 9/2000 | Becker et al. |
| 6,129,838 | A | 10/2000 | Millner |
| 6,170,095 | B1 | 1/2001 | Zars |
| 6,220,784 | B1 | 4/2001 | Bricker |
| 6,230,468 | B1 | 5/2001 | Klaus |
| 6,298,621 | B1 | 10/2001 | Lee |
| 6,443,656 | B1 | 9/2002 | Gunter |
| 6,595,720 | B2 | 7/2003 | Humphries et al. |
| 6,612,780 | B2 | 9/2003 | Dahowski et al. |
| 6,688,806 | B2 | 2/2004 | Kuan |
| 6,755,966 | B1 | 6/2004 | Reed |
| 6,792,723 | B2 | 9/2004 | Stegmeier, Sr. et al. |
| 6,802,962 | B1 | 10/2004 | Browne, III et al. |
| 6,905,285 | B2 | 6/2005 | Little et al. |
| 6,908,256 | B1 | 6/2005 | Humphries et al. |
| 6,942,419 | B2 | 9/2005 | Knak et al. |
| 7,125,506 | B2 | 10/2006 | Humphries et al. |
| 7,246,472 | B2 | 7/2007 | Nielsen |
| 7,413,372 | B2 | 8/2008 | Meyers |
| 7,472,719 | B2 | 1/2009 | Dallmer |
| 7,507,054 | B2 | 3/2009 | Fithian et al. |
| 7,588,392 | B2 | 9/2009 | Wroblewski et al. |
| 7,617,644 | B2 | 11/2009 | Neilsen |
| 7,784,242 | B2 | 8/2010 | Warnecke |
| 7,794,176 | B2 | 9/2010 | Musser |
| 7,862,729 | B2 | 1/2011 | Stetson |
| 7,921,532 | B2 | 4/2011 | Heaton |
| 7,997,038 | B2 | 8/2011 | Warnecke et al. |
| 8,043,497 | B2 | 10/2011 | Silverstein et al. |
| 8,096,002 | B2 | 1/2012 | Stimpson et al. |
| 8,146,308 | B2 | 4/2012 | Warnecke et al. |
| 8,239,974 | B2 | 8/2012 | Erlebach |
| 8,474,068 | B2 | 7/2013 | Kik, Sr. et al. |
| 8,486,260 | B2 | 7/2013 | Tripodi et al. |
| 8,505,131 | B2 | 8/2013 | Doolittle et al. |
| 8,661,642 | B2 | 3/2014 | Heaton |
| 8,826,613 | B1 | 9/2014 | Chrien |
| 8,959,858 | B1 | 2/2015 | Francisco |
| 8,967,190 | B2 | 3/2015 | Keizers |
| 9,127,446 | B2 | 9/2015 | Schlueter |
| 9,334,638 | B1 | 5/2016 | Kirby |
| 9,567,739 | B2 | 2/2017 | Nyce |
| 9,611,634 | B2 | 4/2017 | Erlebach |
| 9,644,363 | B2 | 5/2017 | Meyers |
| 10,017,933 | B1 | 7/2018 | Kirby |
| 10,105,017 | B2 | 10/2018 | Clear et al. |
| 10,106,970 | B2 | 10/2018 | Plank et al. |
| 2005/0166315 | A1 | 8/2005 | Warnecke et al. |
| 2006/0239773 | A1 | 10/2006 | Meyers |
| 2006/0242913 | A1 | 11/2006 | Zhou |
| 2007/0209109 | A1 | 9/2007 | Meyers |
| 2008/0025798 | A1 | 1/2008 | Humphries et al. |
| 2008/0277324 | A1 | 11/2008 | Meyers |
| 2008/0308476 | A1 | 12/2008 | Silverstein et al. |
| 2009/0199382 | A1 | 8/2009 | Heaton |
| 2010/0235982 | A1 | 9/2010 | Stimpson et al. |
| 2010/0288685 | A1 | 11/2010 | Meyers |
| 2010/0320130 | A1 | 12/2010 | Meyers |
| 2011/0023978 | A1* | 2/2011 | Keizers ..... E03F 5/0407 137/362 |
| 2011/0047695 | A1 | 3/2011 | Niedens |
| 2011/0067175 | A1 | 3/2011 | Steylaerts et al. |
| 2011/0154634 | A1 | 6/2011 | Heaton |
| 2011/0162137 | A1* | 7/2011 | Kik, Sr. ..... E03F 3/046 29/428 |
| 2011/0203979 | A1* | 8/2011 | Schlueter ..... E03F 5/0408 210/164 |
| 2011/0303595 | A1* | 12/2011 | Larsson ..... E03F 5/0408 210/164 |
| 2012/0036697 | A1 | 2/2012 | Cook |
| 2012/0037553 | A1 | 2/2012 | Silverstein et al. |
| 2012/0110827 | A1 | 5/2012 | Doolittle et al. |
| 2012/0198778 | A1 | 8/2012 | MacLean et al. |
| 2012/0199216 | A1 | 8/2012 | Schramer |
| 2013/0061387 | A1 | 3/2013 | Stetson et al. |
| 2013/0318704 | A1 | 12/2013 | Plank |
| 2014/0131996 | A1 | 5/2014 | Murphy |
| 2014/0352815 | A1 | 12/2014 | Brodey et al. |
| 2015/0040500 | A1 | 2/2015 | Francisco |
| 2015/0247312 | A1* | 9/2015 | Brodey ..... E03F 5/0407 404/26 |
| 2015/0330068 | A1 | 11/2015 | Schlueter |
| 2018/0238040 | A1 | 8/2018 | Grant |
| 2018/0340319 | A1 | 11/2018 | Schulter |
| 2019/0169831 | A1* | 6/2019 | Wadaga ..... E03F 5/0409 |
| 2021/0010721 | A1* | 1/2021 | Alhazmy ..... F02G 1/055 |
| 2021/0355671 | A1* | 11/2021 | Schluter ..... E03F 5/0408 |

FOREIGN PATENT DOCUMENTS

| | | | |
|---|---|---|---|
| DE | 202010002763 | U1 | 7/2011 |
| EP | 0460686 | A1 | 12/1991 |
| EP | 0802287 | A2 | 10/1997 |
| EP | 1818464 | A1 | 8/2007 |
| EP | 1961879 | A1 | 8/2008 |
| WO | WO 2009/091245 | A1 | 7/2009 |

* cited by examiner

FRAME FOR A FLOOR DRAIN

PRIORITY CLAIM

Priority is claimed of and to German Patent Application Serial No. DE 20 2019 107 083.8, filed Dec. 18, 2019, which is hereby incorporated herein by reference in its entirety.

BACKGROUND OF THE INVENTION

Field of the Invention

The present invention relates to a frame for a floor drain which can be used, in particular, in the construction of flush-with-floor showers.

SUMMARY OF THE INVENTION

It is an object of the present invention to improve the installability of the floor drain and to improve the cleaning of the areas of the floor drain that are accessible after installation.

In order to achieve this object, the present invention provides a frame made of sheet metal and designed to be inserted into a channel body of a floor drain, said channel body forming an outflow channel and having an outflow opening, said frame comprising at least substantially vertically extending side walls arranged in the form of a frame and which together form a receiving opening, and an at least substantially horizontally extending frame flange that surrounds the receiving opening in a frame-like manner and adjoins the upper edges of the side walls, wherein projections projecting into the receiving opening are provided on opposite side walls and form a receiving matrix or receiving means or receiving framework for a cover to be inserted into the frame from above, characterized in that the projections are provided in the form of indentations. A significant advantage of the frame according to the invention is that in the production of the projections in the form of indentations, no recesses, openings or through-holes are made below the projections in the side walls. Accordingly, the step of covering the recesses with adhesive tape is dispensed with, thereby facilitating assembly. Moreover, the frame can be cleaned much more easily in the region of the projections, as water or other liquid will not flow through any openings in the side walls. Furthermore, if there are indentations, the frame need not be deburred in the region of the projections in order to prevent injuries, whereby the manufacture of the frame is simplified and the risk of injury is reduced.

The upwardly facing surfaces of the projections preferably extend at least substantially horizontally in order to provide a good bearing surface for the cover.

The projections are advantageously of elongate design in order to make the bearing surfaces large.

The lower edges of the side walls preferably extend in a straight line, i.e. are not interrupted by recesses.

Furthermore, the present invention provides a floor drain having a channel body forming an outflow channel and having an outflow opening; a frame according to one of the preceding claims which can be inserted into the channel body from above; and a cover which can be inserted into the frame from above, wherein the dimensions of the frame and the cover are matched to each other such that the projections of the frame receive the cover inserted into the frame.

Further features and advantages of the present invention will become apparent from the following description of a frame according to an embodiment of the present invention with reference to the accompanying drawings. These show

DETAILED DESCRIPTION

Figure 1:
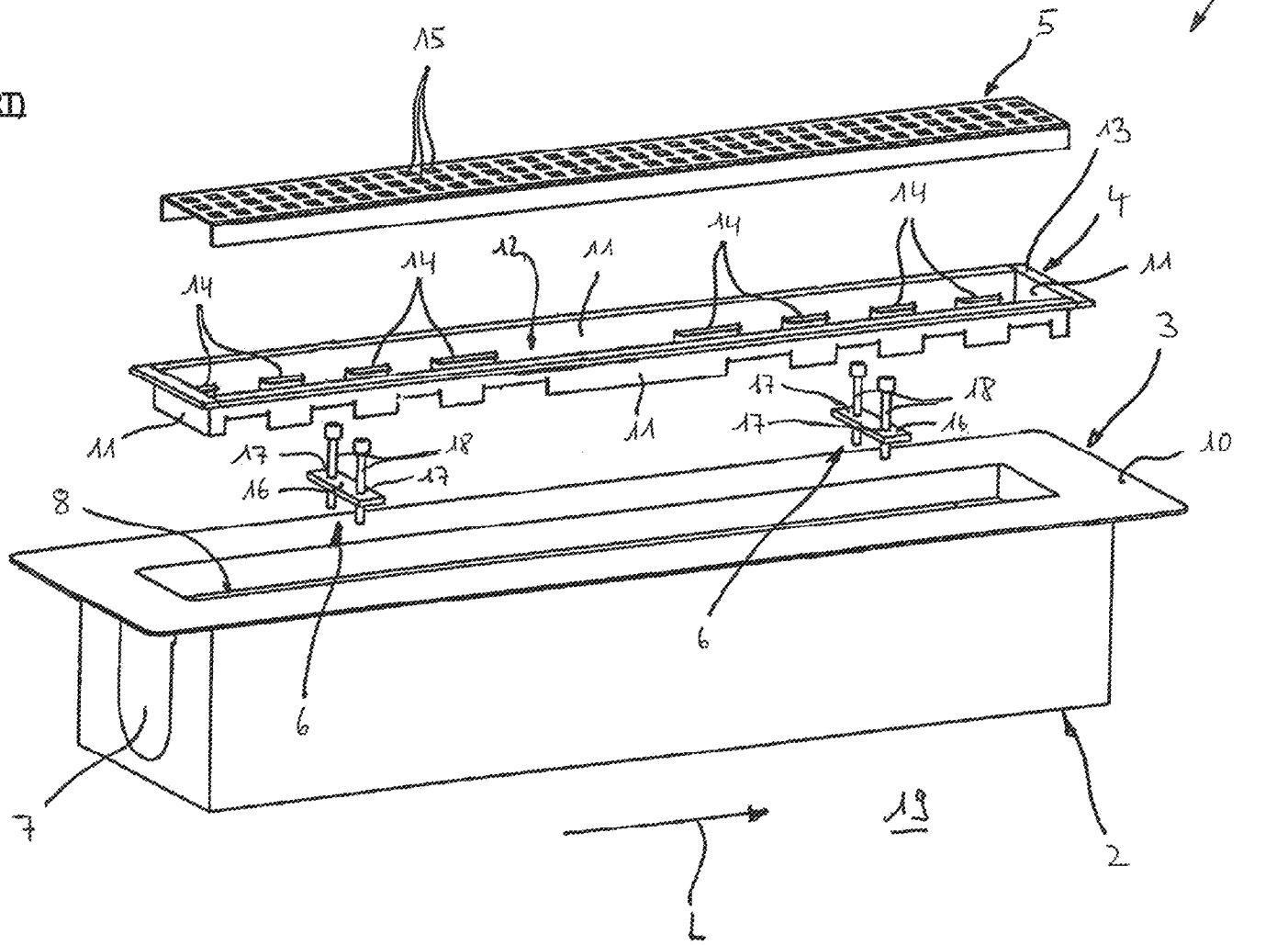
Fig. 1 (PRIOR ART)
FIG. 1 is a schematic perspective view of a floor drain as known in the prior art.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a projection" can include one or more of such projections, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure. Generally, directional terms used in this application, such as "top" or "bottom" refer to the installed state. The formulations "substantially vertical" and "substantially horizontal" are to be construed such that the main extension direction is vertical and horizontal, respectively.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present invention relates to a frame made of sheet metal and designed to be inserted into a channel body of a floor drain, said channel body forming an outflow channel and having an outflow opening, said frame comprising at least substantially vertically extending side walls arranged in the form of a frame and which together form a receiving opening, and an at least substantially horizontally extending frame flange that surrounds the receiving opening in a frame-like manner and adjoins the upper edges of the side walls, wherein projections projecting into the receiving opening are provided on opposite side walls and form a receiving means for a cover to be inserted into the frame from above.

In the following, identical reference numerals denote functionally identical components or component regions as in FIGS. 1 and 2. Furthermore, it is advised that directions used in this application, such as "top" or "bottom" refer to the installed state. The formulations "substantially vertical" and "substantially horizontal" are to be construed such that the main extension direction is vertical and horizontal, respectively.

Floor drains with frames of the aforementioned type are known in principle in the prior art. For example, DE 20 2010 002 763 U1, to the disclosure of which the present application makes full reference, describes the floor drain 1 shown schematically in FIGS. 1 and 2, wherein FIG. 1 shows the basic structure and FIG. 2 shows the installation situation of the floor drain. The floor drain 1 is used primarily in the construction of flush-with-floor showers. It comprises a base body 2, a channel body 3, a frame 4, a cover 5 and two identical spacers 6 used in the assembly of the floor drain 1. The base body 2 is an elongated and substantially rectangular block made of foamed plastic, such as, for example, expanded polystyrene. The base body 2 comprises a longitudinally extending, groove-like and upwardly open recess 7 which serves for receiving a waste pipe, not shown in greater detail, and is formed in the upper region for the substantially form-fitting accommodation of the channel body 3. The channel body 3 is made of sheet metal, for example aluminum or stainless steel sheet. Alternatively, it can also be made of plastic. It forms an outflow channel 8 which is provided with an outflow opening 9 to which the waste pipe to be received by the base body can be connected. The outflow channel 8 is enclosed by an outflow channel flange 10, the underside of which rests on the upper side of the base body 2 in the assembled state of the floor drain 1. The frame 4, made of sheet metal such as aluminum or stainless steel sheet, has substantially vertically extending side walls 11 arranged in a frame configuration which together form a receiving opening 12. Adjoining the upper edges of the side walls 11 is a substantially horizontally extending frame flange 13 which encloses the receiving opening 12 in a frame-like manner and is bent downwards at the free end. Projections 14 projecting into the receiving opening 12 are provided on opposite side walls 11, in the present case on the side walls 11 extending in the longitudinal direction, which projections form a receptacle for the cover 5 to be inserted into the frame 4 from above. The projections 14 are in each case a side wall region positioned between two perpendicular cuts into a side wall 11 and bent upward by 90°. The cover 5 takes the form of a substantially U-shaped metal profile, which can likewise be made of aluminum or stainless steel sheet. On the upper side, the cover 5 is provided with a plurality of through-holes 15 for draining water into the channel body 3. In principle, such through-holes 15 can also be dispensed with. In this case, the cover 5 would have to be made somewhat narrower and be laterally distanced from the side walls 11 of the frame 4 by means of spacers, so that lateral drainage slots are created through which the water to be discharged can pass in the direction of the channel body 3. The spacers 6 each have a rectangular plate element 16 with two threaded holes 17 through which an adjusting screw 18 extends in each case.

Figure 2:
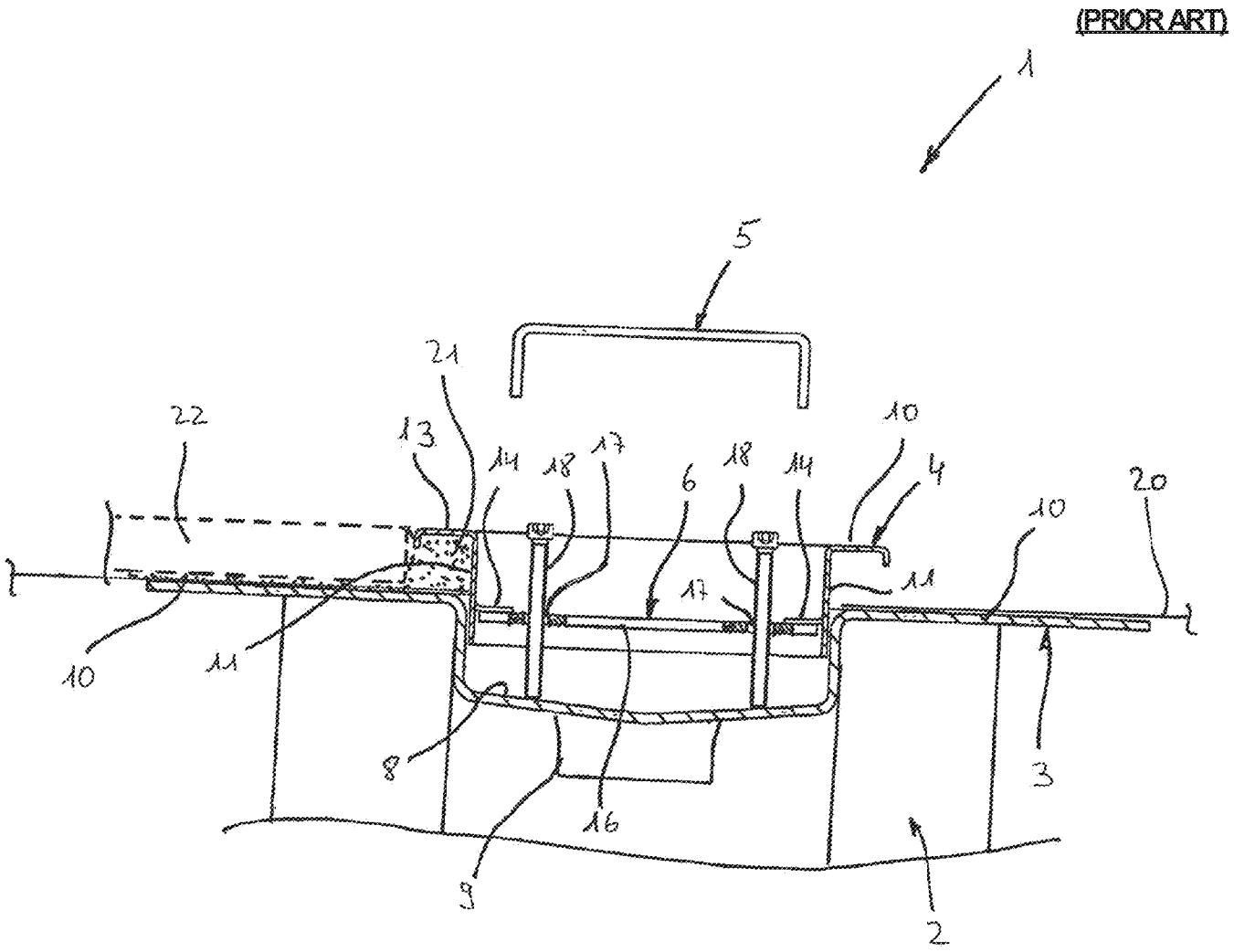
FIG. 2 is a cross-sectional view showing the floor drain shown in FIG. 1 in the installed state.
Figure 3:
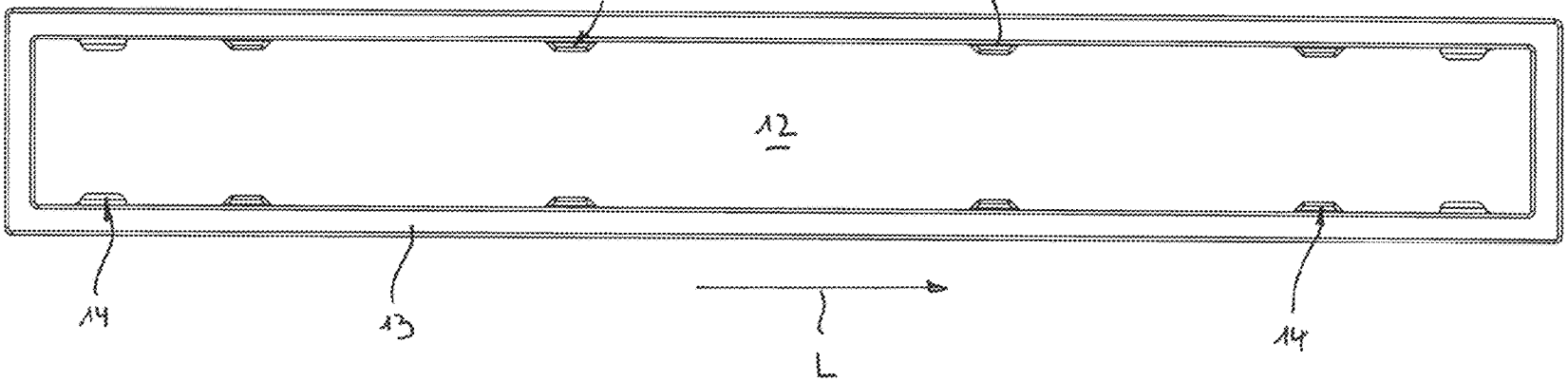
FIG. 3 is a plan view of a frame according to an embodiment of the present invention.
Figure 4:
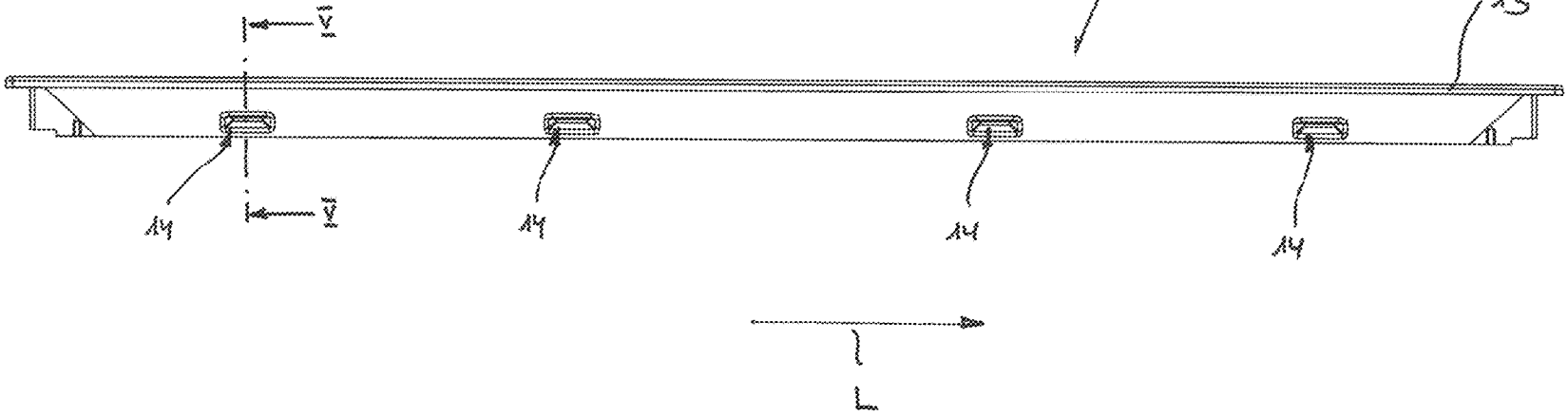
FIG. 4 is a side view of the frame shown in FIG. 3.
Figure 5:
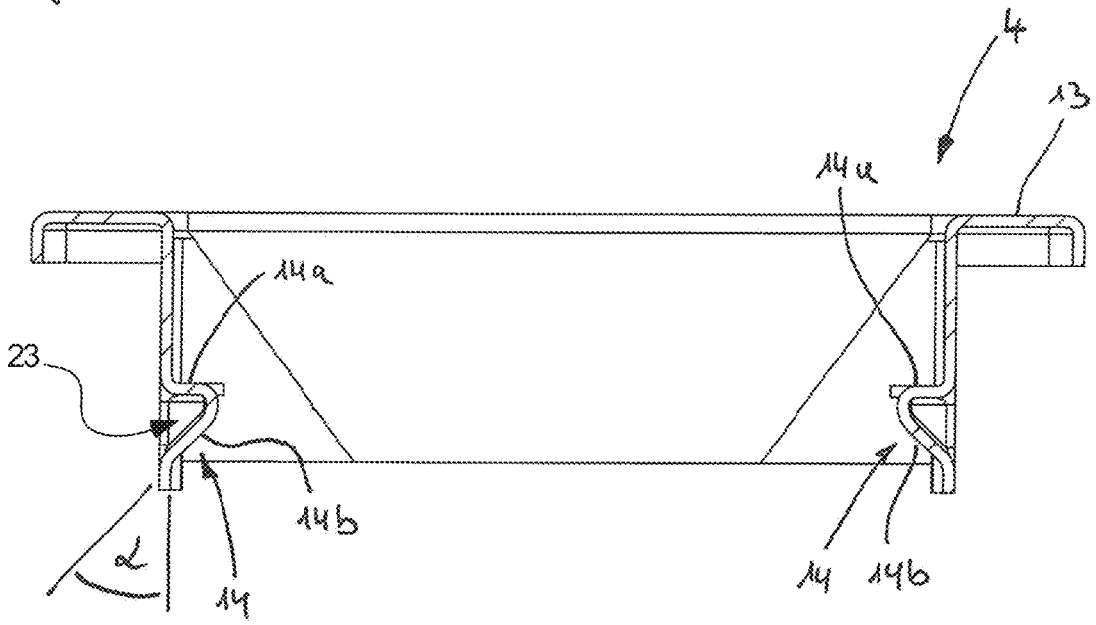
FIG. 5 is a sectional view along the line V-V in FIG. 4.

For the installation of the floor drain 1, as shown in FIG. 2, in a first step the base body 2 with the channel body 3 accommodated therein and connected to a waste pipe is set down on a substrate 19. A sloped board, not shown in detail, is then placed on the base body 2 and forms a slope in the direction of the floor drain 1. Instead of a sloped board, floor screed or the like can also be used. A circumferential sealing collar 20 is then glued to the upper side of the outflow channel flange 10 and projects laterally outwardly beyond the outflow channel flange 10 and covers the surrounding area of the sloped board. In a further step, the outer sides of the longitudinally extending side walls 11 of the frame 4 are sealed with adhesive tape to seal off the recesses provided below the projections 14 in the corresponding side walls, whereupon the frame 4 is arranged on the channel body 3 in such a way that its side walls 11 are partially inserted into the outflow channel 8 of the channel body 3. The two spacers 6 are here positioned at a distance from each other in such a way that the free ends of their plate elements 16 engage below corresponding projections 14 of the frame 4. By manipulating the adjusting screws 18, which are supported on the bottom of the outflow channel 8 of the channel body 3, the distance between the channel body 3 and the frame 4 is then adjusted to the desired amount in order to align the upper side of the frame flange 13 flush with the upper side of the floor covering that is to be installed. In a further step, the sealing collar 20 is fixed to the sloped board, in the present case using thin-bed mortar 21 which is then also used for laying the floor covering, more specifically, tiles 22.

During the course of tiling, the cavity between the outflow channel flange 10 and the frame flange 13 is filled. The previously arranged adhesive tape prevents thin-bed mortar 21 from penetrating through the frame 4 into the channel body 3. Furthermore, the downwardly bent end of the frame flange 13 is embedded in the thin-bed mortar 21. After the thin-bed mortar 21 has hardened to the point where it can support weight, the adjusting screws 18 of the spacers 6 are loosened, whereupon the plate elements 16 of the spacers 6 are removed through the receiving opening 12 of the frame 4. The adhesive tape is then removed. In a final step, the cover 5 is inserted into the frame 4 from above in such a way that it rests on the projections 14 of the frame 4.

Figure 6:
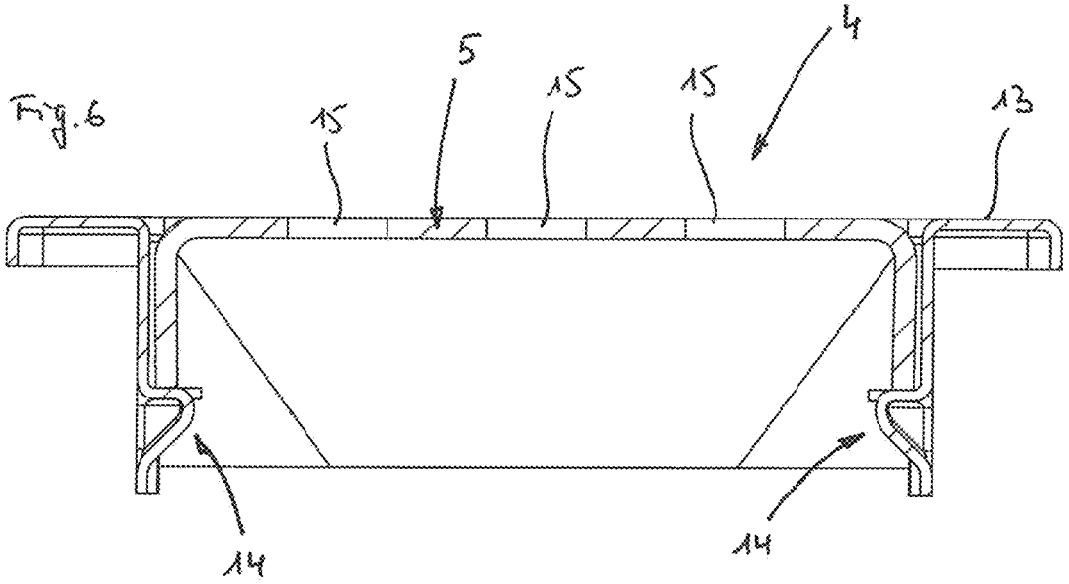
FIG. 6 is a sectional view analogous to FIG. 5, wherein a cover has been inserted into the frame from above.

The frame 4 shown in FIGS. 2 to 6 is made of sheet metal, such as aluminum or stainless steel sheet. It has at least substantially vertically extending side walls 11 arranged in a frame configuration which together form a receiving opening 12. Adjoining the upper edges of the side walls 11 is a frame flange 13 which extends at least substantially horizontally and surrounds the receiving opening 12 in a frame-like manner and is bent downwards at the free end. Projections 14 protruding into the receiving opening 12 are provided on opposite side walls 11, in the present case on the side walls 11 extending in the longitudinal direction L, and form a receptacle for a cover 5 to be inserted into the frame 4 from above, as shown in FIG. 6.

The projections 14 are in the embodiment shown indentations which are produced in the present case by applying external pressure to the side walls 11 with an embossing tool. The upwardly facing surfaces 14*a* of the projections 14 extend at least substantially horizontally. A plurality of the upwardly facing surfaces 14*a* of the projections collectively form a receiving means for receiving The downwardly facing surfaces 14*b* of the projections 14 point obliquely downwards and away from the associated vertical side wall 11. The downward facing surfaces 14*b* and the associated side walls 11 preferably enclose an angle $\alpha$ of 135°±10°, which facilitates the cleaning of the frame 4 in the region of the projections 14. The projections thus create receiving cavities that can receive mortar therein during installation of the frame. The corners of the projections 14 are rounded, which is likewise conducive to simple cleaning. The cover 5 may correspond to the cover 5 previously described with reference to FIGS. 1 and 2.

The frame 4 shown in FIGS. 3 to 6 is designed to be inserted into a channel body 3 of a floor drain 1 which forms an outflow channel 8 and has an outflow opening 9. For example, the frame 4 can thus replace the frame 4 shown in FIGS. 1 and 2. A significant advantage of the frame 4 according to the invention as compared with the frame 4 described with reference to FIGS. 1 and 2 is that the projections 14 are produced in the form of indentations: a such, no recesses or openings or through-holes are produced below the projections 14. Accordingly, the step of covering the recesses with adhesive tape is dispensed with, thereby facilitating assembly. In addition, the projections 14 designed as indentations can receive thin-bed mortar on their rear side during installation, whereby load transfer from the frame is improved. In addition, the frame 4 can be cleaned much more easily from the inside in the region of the projections 14. Furthermore, if there are indentations, the frame 4 need not be deburred in the region of the projections 14 in order to prevent injuries. In the present case, the risk of injury is reduced as no such burrs are created during manufacture.

While the manner in which the projections 14 are formed in the side walls 11 can vary, in some embodiments the projections are formed so that no opening or though-hole It should be understood that the above-described embodiment of a frame according to the invention is not to be understood as restricting the scope of protection. Indeed, modifications of the embodiment are possible without departing from the scope of protection of the present application, which is defined by the appended claims.

LIST OF REFERENCE NUMBERS

1 Floor drain
2 Base body
3 Channel body
4 Frame
5 Cover
6 Spacer
7 Recess
8 Outflow channel
9 Outflow opening
10 Outflow channel flange
11 Side wall
12 Receiving opening
13 Frame flange
14 Projection
15 Through-hole
16 Plate element
17 Threaded hole
18 Adjusting screw
19 Substrate
20 Sealing collar
21 Thin-bed mortar
22 Tile
23 Receiving cavity
L Longitudinal direction

I claim:

1. A frame (4) made of sheet metal and designed to be inserted into a channel body (3) of a floor drain (1), said channel body forming an outflow channel (8) and having an outflow opening (9), said frame comprising at least substantially vertically extending side walls (11) arranged in the form of a frame and which together form a receiving opening (12), and an at least substantially horizontally extending frame flange (13) that adjoins the upper edges of the side walls (11) and surrounds the receiving opening (12) in a frame-like manner, wherein projections (14) projecting into the receiving opening (12) are provided on opposite side walls (11) and form a receiving framework to receive and support a cover (5) to be inserted into the frame (4) from above, characterized in that the projections (14) are provided in the form of indentations.

2. The frame (4) according to claim 1, wherein the upwardly facing surfaces of the projections (14) extend at least substantially horizontally.

3. The frame (4) according to claim 1, wherein the projections (14) are of elongate design.

4. The frame (4) according to claim 1, wherein the lower edges of the side walls (11) extend in a straight line.

5. The frame (4) of claim 4, wherein the floor drain (1) has a channel body (3) which forms an outflow channel (8) and has an outflow opening (9); a frame (4) which can be inserted into the channel body (3) from above; and further comprising a cover (5) which can be inserted into the frame (4) from above, wherein the dimensions of the frame (4) and the cover (5) are matched to one another such that the projections (14) of the frame (4) receive the cover (5) inserted into the frame (4).

6. The frame (4) of claim 1, wherein an area of the side walls 11 surrounding the projections 14 is devoid of openings or through-holes.

7. The frame (4) of claim 6, wherein the frame is formed as an integral, unitary piece of material.

8. The frame (4) of claim 6, wherein the projections form receiving cavities configured to receive thin-bed mortar therein during installation of the frame.

* * * * *